US010204548B2

(12) United States Patent
Lee et al.

(10) Patent No.: US 10,204,548 B2
(45) Date of Patent: Feb. 12, 2019

(54) DISPLAY DEVICE AND OPERATING METHOD THEREOF

(71) Applicant: SAMSUNG DISPLAY CO., LTD., Yongin, Gyeonggi-do (KR)

(72) Inventors: Ki Seob Lee, Yongin-si (KR); Hyun Il Park, Yongin-si (KR); On Sik Choi, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 238 days.

(21) Appl. No.: 15/134,430

(22) Filed: Apr. 21, 2016

(65) Prior Publication Data

US 2017/0098410 A1 Apr. 6, 2017

(30) Foreign Application Priority Data

Oct. 1, 2015 (KR) ..... 10-2015-0138748

(51) Int. Cl.

| | |
|---|---|
| ***G09G 3/20*** | (2006.01) |
| ***G09G 3/3258*** | (2016.01) |
| ***G09G 3/36*** | (2006.01) |
| ***G09G 3/28*** | (2013.01) |
| ***G09G 3/3266*** | (2016.01) |
| ***G09G 3/3291*** | (2016.01) |

(52) U.S. Cl.

CPC ..... *G09G 3/2096* (2013.01); *G09G 3/28* (2013.01); *G09G 3/3258* (2013.01); *G09G 3/3266* (2013.01); *G09G 3/3291* (2013.01); *G09G 3/3677* (2013.01); *G09G 3/3688* (2013.01); *G09G 2330/028* (2013.01)

(58) Field of Classification Search

CPC ..... G09G 3/2096; G09G 3/28; G09G 3/3258; G09G 3/3266; G09G 3/3291; G09G 3/3677; G09G 3/3688; G09G 2330/028

USPC ..... 345/212

See application file for complete search history.

(56) References Cited

U.S. PATENT DOCUMENTS

| | | | | |
|---|---|---|---|---|
| 6,904,295 | B2 * | 6/2005 | Yang | H04W 52/52 455/522 |
| 2003/0128740 | A1 * | 7/2003 | Iwamoto | H04B 1/7075 375/130 |
| 2004/0181698 | A1 * | 9/2004 | Williams | G06F 1/28 713/300 |

(Continued)

FOREIGN PATENT DOCUMENTS

KR 1020070028141 A 3/2007

*Primary Examiner* — Benyam Ketema

(74) *Attorney, Agent, or Firm* — Cantor Colburn LLP

(57) ABSTRACT

A display device includes a display unit including a plurality of pixels for displaying images, a scan driver which supplies scan signals to the plurality of pixels, a data driver which supplies data signals to the plurality of pixels, a communication module which measures a reception rate of communication signals received through an antenna, a processor which compares the reception rate with a reference reception rate and generating a driving voltage control signal, based on a determination result, and a power supply which generates a first driving voltage to be supplied to each of the scan driver and the data driver where the power supply changes at least one of a first slew rate and a first frequency of the first driving voltage, based on the driving voltage control signal, thereby generating a second driving voltage having at least one of a second slew rate and a second frequency.

14 Claims, 4 Drawing Sheets

(56) References Cited

U.S. PATENT DOCUMENTS

| | | | | |
|---|---|---|---|---|
| 2004/0252668 | A1* | 12/2004 | Ozukturk | H04B 1/707 370/335 |
| 2005/0141656 | A1* | 6/2005 | Choi | H04B 1/30 375/345 |
| 2014/0139415 | A1* | 5/2014 | Stronks | G09G 3/3696 345/87 |
| 2015/0340013 | A1* | 11/2015 | Lee | G09G 5/18 345/213 |
| 2016/0275897 | A1* | 9/2016 | Lin | G09G 3/3688 |

* cited by examiner

DISPLAY DEVICE AND OPERATING METHOD THEREOF

This application claims priority to Korean Patent Application No. 10-2015-0138748, filed on Oct. 1, 2015, and all the benefits accruing therefrom under 35 U.S.C. § 119, the content of which in its entirety is herein incorporated by reference.

BACKGROUND

1. Field

Exemplary embodiments of the invention relate to a display device and an operating method thereof.

2. Description of the Related Art

Recently, various types of display devices including an organic light emitting display device, a liquid crystal display device, a plasma display device, and the like, have been widely used.

Each of these display devices generally includes a display panel including pixels emitting light, a driving controller for generating control signals to be supplied to the pixels, and a power supply for generating power to drive the display device.

The power supply receives an input voltage applied from an external power source such as a battery, and generates a driving voltage by boosting or dropping the applied input voltage.

SUMMARY

A power supply may generate an interference signal while generating a driving voltage. The interference signal may have influence on other signals of the display device. Particularly, the interference signal may have influence on communication signals received through an antenna.

Exemplary embodiments provide a display device and an operating method thereof, in which the generation of noise is reduced by adjusting the frequency and slew rate of a driving voltage, so that it is possible to increase the reception rate of communication signals.

According to an exemplary embodiment of the invention, there is provided a display device including a display unit which include a plurality of pixels for displaying images, a scan driver which supply scan signals to the pixels, a data driver which supply data signals to the pixels, a communication module which measure a reception rate of communication signals received through an antenna, a processor which compare the reception rate with a reference reception rate, and generate a driving voltage control signal, based on a determination result, and a power supply which generate a first driving voltage to be supplied to each of the scan driver and the data driver, wherein the power supply changes at least one of a first slew rate and a first frequency of the first driving voltage, based on the driving voltage control signal, thereby generating a second driving voltage having at least one of a second slew rate different from the first slew rate and a second frequency different from the first frequency.

In an exemplary embodiment, the display device may further include a memory which stores a look-up table including at least one of the second slew rate and the second frequency.

In an exemplary embodiment, the first slew rate may have a greater value than the second slew rate.

In an exemplary embodiment, the first frequency may have a higher value than the second frequency.

In an exemplary embodiment, the processor may include a reception rate comparator which determines whether the first driving voltage is to be changed by comparing the reception rate with the reference reception rate, a reception rate controller which determines the second slew rate and the second frequency, corresponding to the comparison result, based on whether the first driving voltage is to be changed, and a driving voltage control signal generator which generates the driving voltage control signal using at least one of the second slew rate and the second frequency.

In an exemplary embodiment, when the reception rate is smaller than the reference reception rate, the reception rate comparator may determine that the first driving voltage is to be changed.

In an exemplary embodiment, the reception rate controller may determine the second slew rate and the second frequency to have different values for every communication frequency band.

In an exemplary embodiment, the power supply may include a receiver which receives the driving voltage control signal from the processor, a driving voltage generator which generates the first driving voltage, and a driving voltage regulator which generates the second driving voltage by adjusting the first driving voltage, based on the driving voltage control signal.

In an exemplary embodiment, the receiver may receive the driving voltage control signal through an inter-integrated circuit ("I2C") interface.

In an exemplary embodiment, the driving voltage generator may generate the first driving voltage by boosting a direct-current ("DC") input voltage.

In an exemplary embodiment, when the second slew rate and the second frequency are not included in the driving voltage control signal, the driving voltage regulator may set the first driving voltage as the second driving voltage.

According to an exemplary embodiment of the invention, there is provided a method of operating a display device including a power supply for supplying a first driving voltage to each component of the display device and a processor for controlling the power supply, the method including generating, by the processor, a driving voltage control signal using a reception rate of communication signals and a reference reception rate, and generating, by the power supply, a second driving voltage by adjusting the first driving voltage, based on the driving voltage control signal.

In an exemplary embodiment, the generating of the driving voltage control signal may include receiving a reception rate of communication signals from a communication module, determining whether the first driving voltage is to be changed by comparing the reception rate with the reference reception rate, selecting at least one of a second slew rate and a second frequency, based on whether the first driving voltage is to be changed, and generating the driving voltage control signal including at least one of the second slew rate and the second frequency, based on a selection result.

In an exemplary embodiment, in the determining of whether the first driving voltage is to be changed, it may be determined that the first driving voltage is to be changed when the reception rate is smaller than the reference reception rate.

In an exemplary embodiment, in the generating of the second driving voltage, the driving voltage control signal may be received from the processor, and the second driving voltage may be generated, based on the driving voltage control signal, using the first driving voltage generated based on an input voltage.

In an exemplary embodiment, in the generating of the second driving voltage, the second driving voltage may be generated by changing at least one of a first slew rate and a first frequency, based on the second slew rate and the second frequency, included in the driving voltage control signal.

In the display device and the operating method thereof according to the invention, the frequency and slew rate of a driving voltage are adjusted based on a reception rate of communication signals, so that it is possible to minimize the generation of noise and increase the reception rate of communication signals.

Also, it is possible to efficiently control the reception rate of communication signals, regardless of characteristics for each component of the display device.

BRIEF DESCRIPTION OF THE DRAWINGS

Exemplary embodiments will now be described more fully hereinafter with reference to the accompanying drawings, in which.

DETAILED DESCRIPTION

Figure 1:
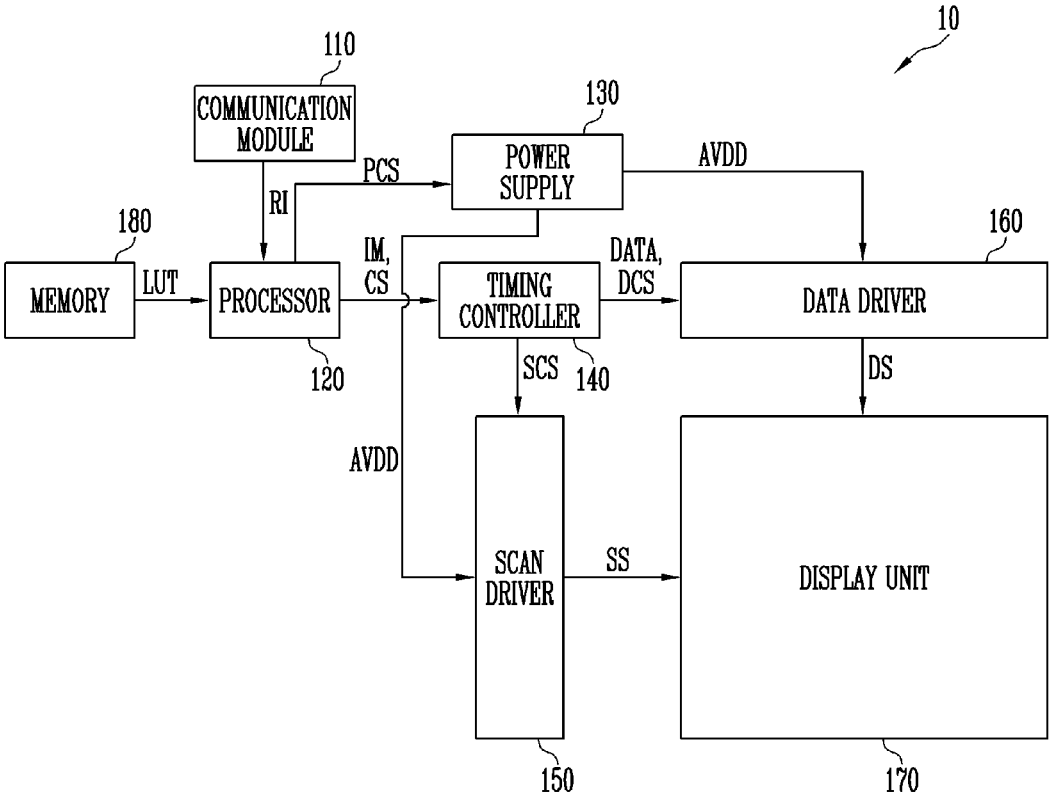
FIG. 1 is a schematic block diagram illustrating a display device according to an exemplary embodiment of the invention.

The specific structural or functional description disclosed herein is merely illustrative for the purpose of describing exemplary embodiments according to the concept of the invention. The exemplary embodiments according to the concept of the invention can be implemented in various forms, and can not be construed as limited to the exemplary embodiments set forth herein.

The exemplary embodiments according to the concept of the invention can be variously modified and have various shapes. Thus, the exemplary embodiments are illustrated in the drawings and are intended to be described herein in detail. However, the exemplary embodiments according to the concept of the invention are not construed as limited to specified inventions, and include all changes, equivalents, or substitutes that do not depart from the spirit and technical scope of the invention.

While terms such as "first" and "second" may be used to describe various components, such components must not be understood as being limited to the above terms. The above terms are used only to distinguish one component from another. In an exemplary embodiment, a first component may be referred to as a second component without departing from the scope of rights of the invention, and likewise a second component may be referred to as a first component.

It will be understood that when an element is referred to as being "connected to" another element, it can be directly connected to the other element or intervening elements may also be present. In contrast, when an element is referred to as being "directly connected to" another element, no intervening elements are present, other expressions describing relationships between components such as "~ between," "immediately ~ between" or "adjacent to ~" and "directly adjacent to ~" may be construed similarly.

The terms used in the application are merely used to describe particular exemplary embodiments, and are not intended to limit the invention. Singular forms in the invention are intended to include the plural forms as well, unless the context clearly indicates otherwise. It will be further understood that terms such as "including" or "having," etc., are intended to indicate the existence of the features, numbers, operations, actions, components, parts, or combinations thereof disclosed in the specification, and are not intended to preclude the possibility that one or more other features, numbers, operations, actions, components, parts, or combinations thereof may exist or may be added.

So far as not being differently defined, all terms used herein including technical or scientific terminologies have meanings that they are commonly understood by those skilled in the art to which the invention pertains. The terms having the definitions as defined in the dictionary should be understood such that they have meanings consistent with the context of the related technique. So far as not being clearly defined in this application, terms should not be understood in an ideally or excessively formal way.

It will be understood that when an element is referred to as being "on" another element, it can be directly on the other element or intervening elements may be therebetween. In contrast, when an element is referred to as being "directly on" another element, there are no intervening elements present.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an exemplary embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath"

other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an exemplary embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

Hereinafter, exemplary embodiments of the invention will be described in detail with reference to the accompanying drawings.

FIG. 1 is a schematic block diagram illustrating a display device according to an exemplary embodiment of the invention.

Referring to FIG. 1, the display device 10 includes a communication module 110, a processor 120, a power supply 130, a timing controller 140, a scan driver 150, a data driver 160, a display unit 170, and a memory 180.

The communication module 110 may be coupled to an antenna (not shown) to receive communication signals. The communication module 110 may measure a reception rate, based on a reception sensitivity of communication signals. Then, the communication module 110 may generate reception rate information RI including the measured reception rate and transmit the generated reception rate information RI to the processor 120.

According to an exemplary embodiment, the communication module 110 may generate the reception rate information RI by measuring, in real time, a reception rate of communication signals.

The processor 120 may generate a driving voltage control signal PCS for adjusting a driving voltage AVDD by analyzing the reception rate information RI.

In an exemplary embodiment, the processor 120 may be implemented as an integrated circuit ("IC"), an application processor ("AP"), a mobile AP, etc., but the invention is not limited thereto.

According to an exemplary embodiment, the processor 120 may generate the driving voltage control signal PCS by analyzing, in real time, the reception rate information RI transmitted from the communication module 110.

Also, the processor 120 may transmit an image signal IM and a control signal CS to the timing controller 140. In an exemplary embodiment, the control signal CS may include a vertical synchronization signal, a horizontal synchronization signal, a data enable signal, a clock signal, and the like, for example.

The power supply 130 may generate power required to drive the display device 10, and supply the generated power to each component. In an exemplary embodiment, the power supply 130 may generate a driving voltage AVDD using an input voltage, and supply the driving voltage AVDD to the scan driver 150 and the data driver 160.

The power supply 130 may control the driving voltage AVDD in response to the driving voltage control signal PCS received from the processor 120. In this case, the power supply 130 may control the generation of the driving voltage AVDD, thereby removing noise generated when the driving voltage AVDD is generated.

The noise generated when the driving voltage AVDD is generated may have influence on other signals. Particularly, the noise may have influence on communication signals, thereby reducing the reception rate.

Therefore, in order to increase the reception rate, the power supply 130 may adjust at least one of a frequency and a slew rate of the driving voltage AVDD in response to the driving voltage control signal PCS. Here, the slew rate means a change rate of an output voltage per unit time.

The timing controller 140 may generate a scan control signal SCS and a data control signal DCS using the control signal CS transmitted from the processor 120.

The timing controller 140 may transmit, to the scan driver 150, the scan control signal SCS for controlling the scan driver 150, and transmit, to the data driver 160, the data control signal DCS for controlling the data driver 160.

Also, the timing controller 140 may generate image data DATA using the image signal IM, and transmit the image data DATA to the data driver 160.

The scan driver 150 may transmit a scan signal SS to scan lines in response to the scan control signal SCS. The scan driver 150 may be driven by the driving voltage AVDD supplied from the power supply 130.

The data driver 160 may generate a data signal DS using the image data DATA and the data control signal DCS, and transmit the data signal DS to data lines. The data driver 160 may be driven by the driving voltage AVDD supplied from the power supply 130.

The display unit 170 may include pixels coupled to the scan lines and the data lines to display a predetermined image.

Each of the pixels may receive the data signal DS supplied from a data line when the scan signal SS is supplied to a scan line, and emit light with a luminance corresponding to the data signal DS.

According to an exemplary embodiment, the display unit 170 may be implemented as an organic light emitting display panel, a liquid crystal display panel, a plasma display panel, etc., but the invention is not limited thereto.

The memory 180 may store a look-up table LUT including a new slew rate and a new frequency of the driving voltage AVDD. The memory 180 may transmit the look-up table LUT to the processor 120 in response to a request of the processor 120.

Figure 2:
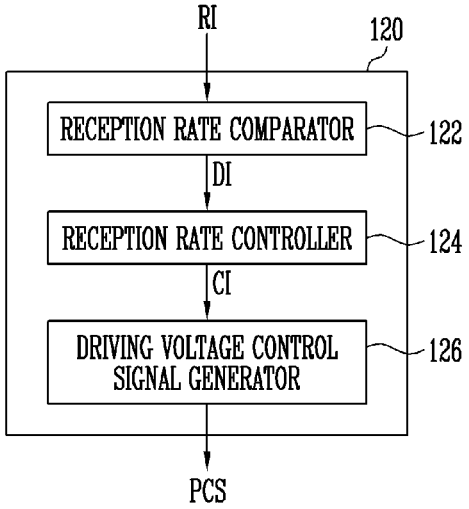
FIG. 2 is a schematic block diagram illustrating a processor shown in FIG. 1.

FIG. 2 is a schematic block diagram illustrating the processor shown in FIG. 1.

Referring to FIGS. 1 and 2, the processor 120 includes a reception rate comparator 122, a reception rate controller 124, and a driving voltage control signal generator 126.

The reception rate comparator 122 may determine whether a first driving voltage is to be adjusted by analyzing reception rate information RI received from the communication module 110. Here, the first driving voltage means a current driving voltage AVDD that the power supply supplies to each component of the display device.

The reception rate comparator 122 may generate determination information DI, based on a determination result, and transmit the generated determination information DI to the reception rate controller 124.

According to an exemplary embodiment, the reception rate comparator 122 may determine whether the first driving voltage is to be adjusted by comparing a current reception rate included in the reception rate information RI with a previously set reference reception rate, and generate determination information DI on the determination result.

In an exemplary embodiment, when the current reception rate included in the reception rate information RI is lower than the reference reception rate, the reception rate comparator 122 may generate determination information DI including information that the first driving voltage is to be adjusted, and transmit the generated determination information DI to the reception rate controller 124, for example.

In an exemplary embodiment, when the current reception rate included in the reception rate information RI is equal to or greater than the reference reception rate, the reception rate comparator 122 may generate determination information DI including information that the first driving voltage is not to be adjusted, and transmit the generate determination information DI to the reception rate controller 124, for example.

Here, the reception rate comparator 122 may use different reference reception rates for every communication frequency band.

The reception rate controller 124 may determine a change value of the first driving voltage in response to the determination information DI received from the reception rate comparator 122.

When the determination information DI including information that the first driving voltage is not to be adjusted is received, the reception rate controller 124 may generate control information CI including information that the first driving voltage is not to be adjusted, and transmit the generated control information CI to the driving voltage control signal generator 126.

When the determination information DI including information that the first driving voltage is to be adjusted is received, the reception rate controller 124 may generate control information CI including a change value of the first driving voltage, and transmit the generated control information CI to the driving voltage control signal generator 126.

Specifically, the reception rate controller 124 may analyze a difference between a current reception rate included in the determination information DI with the reference reception rate, and acquire at least one of a new slew rate (i.e., second slew rate) and a new frequency (i.e., second frequency) from the look-up table LUT stored in the memory 180 so as to increase a reception rate corresponding to the difference.

In an exemplary embodiment, in order to change at least one of a first slew rate and a first frequency of the first driving voltage, the reception rate controller 124 may generate control information CI by acquiring at least one of the second slew rate and the second frequency from the look-up table LUT, for example.

The driving voltage control signal generator 126 may generate a driving voltage control signal PCS, based on the control information CI received from the reception rate controller 124. Here, the driving voltage control signal PCS is a signal controlling the generation of the first driving voltage, and may include at least one of the second slew rate and the second frequency.

Figure 3:
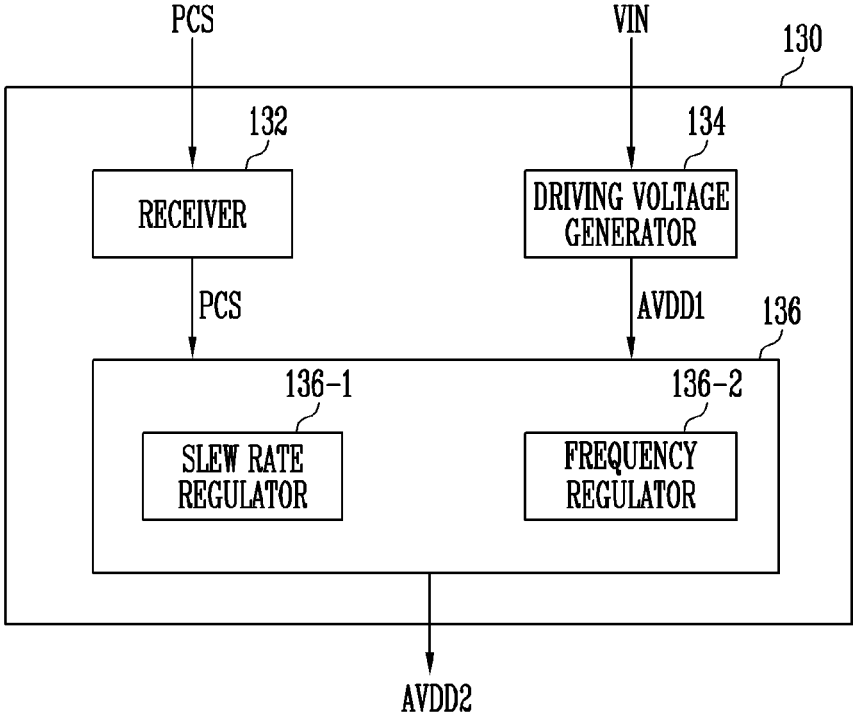
FIG. 3 is a schematic block diagram illustrating a power supply shown in FIG. 1.
Figure 4A:
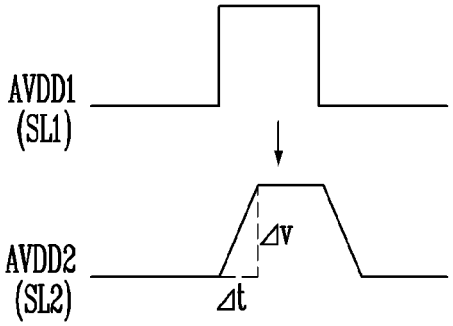
FIG. 4A is a conceptual diagram illustrating a method in which a driving voltage regulator shown in FIG. 3 generates a second driving voltage by adjusting the slew rate of a first driving voltage.
Figure 4B:
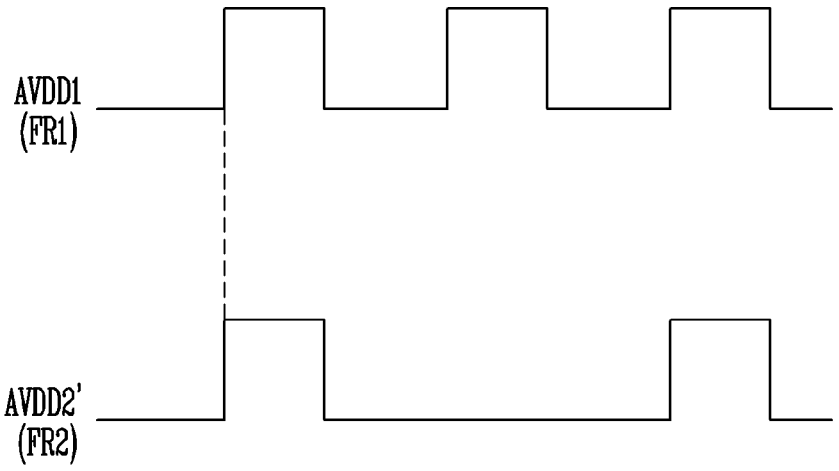
FIG. 4B is a conceptual diagram illustrating a method in which the driving voltage regulator shown in FIG. 3 generates a second driving voltage by adjusting the frequency of the first driving voltage.
Figure 4C:
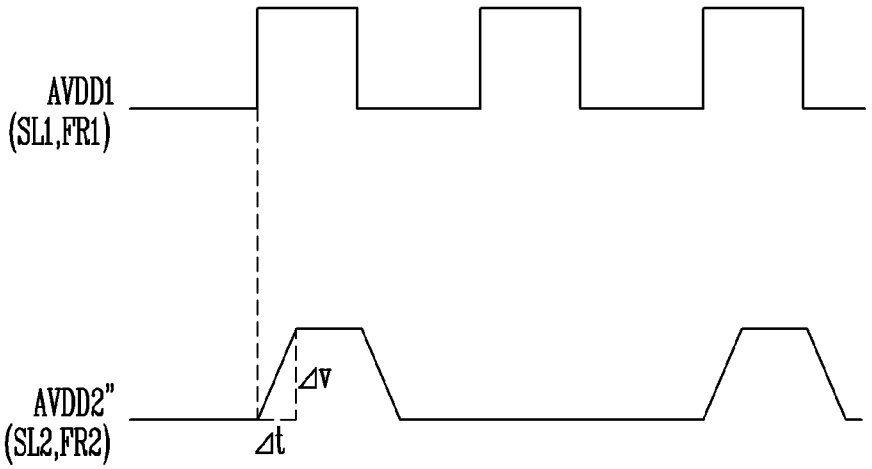
FIG. 4C is a conceptual diagram illustrating a method in which the driving voltage regulator shown in FIG. 3 generates a second driving voltage by adjusting the slew rate and frequency of the first driving voltage.

FIG. 3 is a schematic block diagram illustrating the power supply shown in FIG. 1. FIG. 4A is a conceptual diagram illustrating a method in which a driving voltage regulator shown in FIG. 3 generates a second driving voltage by adjusting the slew rate of a first driving voltage. FIG. 4B is a conceptual diagram illustrating a method in which the driving voltage regulator shown in FIG. 3 generates a second driving voltage by adjusting the frequency of the first driving voltage. FIG. 4C is a conceptual diagram illustrating a method in which the driving voltage regulator shown in FIG. 3 generates a second driving voltage by adjusting the slew rate and frequency of the first driving voltage.

First, an operation of the power supply 130 according to an exemplary embodiment of the invention will be described with reference to FIG. 3. The power supply 130 includes a receiver 132, a driving voltage generator 134, and a driving voltage regulator 136.

The receiver 132 may receive a driving voltage control signal PCS from the processor 120, and transmit the received driving voltage control signal PCS to the driving voltage regulator 136.

In an exemplary embodiment, the receiver 132 may receive the driving voltage control signal PCS through an inter-integrated circuit ("I2C") interface. Here, the I2C interface is an interface that changes a function through software without changing hardware and support a one-to-many communication function. However, the invention is not limited to the I2C interface, and the receiver 132 may use various other interface methods.

According to an exemplary embodiment, the power supply 130 may have a separate memory (not shown) provided therein. The memory (not shown) may store a driving voltage control signal PCS received from the receiver 132, and transmit the driving voltage control signal PCS to the driving voltage regulator 136 in response to a request of the driving voltage regulator 136. In an exemplary embodiment, the memory (not shown) may be implemented as an EPROM, but the invention is not limited thereto.

The driving voltage generator 134 may generate a first driving voltage AVDD1 having a square waveform, based on an input voltage VIN, and transmit the first driving voltage AVDD1 to the driving voltage regulator 136. In an exemplary embodiment, the driving voltage generator 134 may be a boost converter that receives a direct-current ("DC") voltage to output a high DC voltage.

The driving voltage generator 134 may generate noise when the first driving voltage AVDD1 is generated. The degree of generation of noise may be changed depending on a slew rate and a frequency of the first driving voltage AVDD1.

In an exemplary embodiment, the noise may increase as the slew rate of the first driving voltage AVDD1 becomes greater. Also, the noise may decrease as the slew rate of the first driving voltage AVDD1 becomes smaller, for example.

In an exemplary embodiment, the noise may increase as the frequency of the first driving voltage AVDD1 becomes higher. Also, the noise may decrease as the frequency of the first driving voltage AVDD1 becomes lower, for example.

The driving voltage regulator 136 may generate a second driving voltage AVDD2, based on the driving voltage control signal PCS and the first driving voltage AVDD1, and transmit the second driving voltage AVDD2 to components (e.g., the data driver 160 and the scan driver 150) of the display device.

The driving voltage regulator 136 may include a slew rate regulator 136-1 and a frequency regulator 136-2.

When a new slew rate (i.e., second slew rate) is included in the driving voltage control signal PCS, the slew rate regulator 136-1 may change the first slew rate of the first driving voltage AVDD1 to the second slew rate, thereby generating the second driving voltage AVDD2.

When a new frequency (i.e., second frequency) is included in the driving voltage control signal PCS, the frequency regulator 136-2 may change the first frequency of the first driving voltage AVDD1 to the second frequency, thereby generating the second driving voltage AVDD2.

If the second slew rate and the second frequency of the first driving voltage AVDD1 are not included in the driving voltage control signal PCS, the driving voltage regulator 136 may supply the first driving voltage AVDD1 as the second driving voltage AVDD2 to the components (e.g., the data driver 160 and the scan driver 150) of the display device.

Referring to FIGS. 3 and 4A, according to an exemplary embodiment, the driving voltage regulator 136 may reduce the generation of noise by adjusting only the slew rate. The first driving voltage AVDD1 may be input as a driving pulse having a square waveform to the driving voltage regulator 136.

For convenience of illustration, it is illustrated that the first slew rate SL1 of the first driving voltage AVDD1 is a square wave having an infinite value. However, the invention is not limited thereto, and the first driving voltage AVDD1 may be implemented to have a constant slew rate.

If a new slew rate (second slew rate SL2) is included in the driving voltage control signal PCS, the driving voltage regulator 136 may change the first slew rate SL1 of the first driving voltage AVDD1 to the second slew rate SL2, thereby generating a second driving voltage AVDD2. The second slew rate SL2 included in the driving voltage control signal PCS may be a smaller value than the first slew rate SL1.

The second slew rate SL2 is determined based on the following equation. Here, ΔV is a variation in driving voltage, and Δt is a variation in unit time.

$$SL2=\Delta V/\Delta t \quad \text{<Equation>}$$

The driving voltage regulator 136 generates the second driving voltage AVDD2 having the second slew rate SL2, thereby reducing the generation of noise. As the slew rate of the second driving voltage AVDD2 supplied to the components (e.g., the data driver 160 and the scan driver 150) becomes smaller, the generation of noise is reduced, and hence the reception rate of communication signals may be increased.

According to an exemplary embodiment, the driving voltage regulator 136 may generate the second driving voltage AVDD2 using the second slew rate having a greater value than the first slew rate SL1.

This is because the degree of generation of noise corresponding to the slew rate may be changed for every communication frequency band. Thus, the second driving voltage AVDD2 is generated using the second slew rate having a greater value than the first slew rate SL1.

Referring to FIGS. 3 and 4B, according to another exemplary embodiment, the driving voltage regulator 136 may reduce the generation of noise by adjusting only the frequency.

The first driving voltage AVDD1 may be input as a driving pulse having a square waveform to the driving voltage regulator 136. When a new frequency (i.e., second frequency FR2) is included in the driving voltage control signal PCS, the driving voltage regulator 136 may change the first frequency FR1 of the first driving voltage AVDD1 to the second frequency FR2, thereby generating the second driving voltage AVDD2'. The second frequency FR2 included in the driving voltage control signal PCS may be a smaller value than the first frequency FR1.

The driving voltage regulator 136 generates the second driving voltage AVDD2' having the second frequency FR2, thereby reducing the generation of noise. As the frequency of the second driving voltage AVDD2' supplied to the components (e.g., the data driver 160 and the scan driver 150) becomes lower, the generation of noise is reduced, and hence it is possible to prevent a phenomenon that the reception rate of communication signals is reduced.

According to an exemplary embodiment, the driving voltage regulator 136 may generate the second driving voltage AVDD2' using the second frequency FR2 higher than the first frequency FR1. This is because the degree of generation of noise may be changed for every communication frequency band. Thus, the second driving voltage AVDD2' is generated using the second frequency FR2 higher than the first frequency FR1, thereby reducing the generation of noise.

Referring to FIGS. 3 and 4C, according to still another exemplary embodiment, the driving voltage regulator 136 may reduce the generation of noise by adjusting the slew rate and the frequency. The driving voltage regulator 136 according to the exemplary embodiment of the invention performs the substantially same function as FIGS. 4A and 4B, and therefore, overlapping descriptions will be omitted.

If the second slew rate SL2 and the second frequency FR2 are included in the driving voltage control signal PCS, the driving voltage regulator 136 may change the first slew rate SL1 of the first driving voltage AVDD1 to the second slew rate SL2 and change the first frequency FR1 of the first driving voltage AVDD1 to the second frequency FR2, thereby generating a second driving voltage AVDD2".

Here, the second slew rate SL2 included in the driving voltage control signal PCS may be smaller than the first slew rate SL1, and the second frequency FR2 included in the driving voltage control signal PCS may be lower than the first frequency FR1.

As such, when the first slew rate SL1 and the first frequency FR1 of the first driving voltage AVDD1 are simultaneously changed, it is possible to remarkably reduce the generation of noise due to the generation of a driving voltage. Thus, the driving voltage regulator 136 generates the second driving voltage AVDD2" having the second slew rate SL2 and the second frequency FR2, thereby remarkably reducing the reception rate of communication signals.

According to an exemplary embodiment, the driving voltage regulator 136 may generate the second driving voltage AVDD2" using the second slew rate SL2 greater than the first slew rate SL1 and the second frequency FR2 higher than the first frequency FR1.

However, the degree of generation of noise corresponding to the frequency of a driving voltage may be changed for every communication frequency band, and hence the invention is not limited thereto. The driving voltage regulator 136 may generate the second driving voltage AVDD2" using various slew rates and frequencies so as to minimize the generation of noise.

Figure 5:
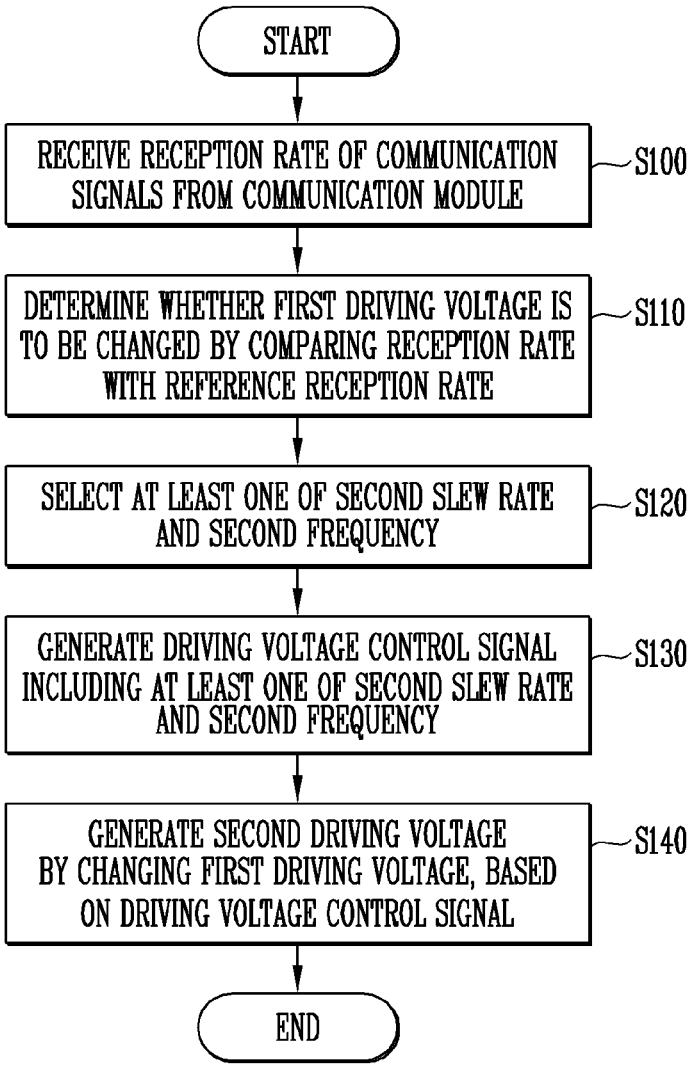
FIG. 5 is a flowchart illustrating an operating method of the display device according to an exemplary embodiment of the invention.

FIG. 5 is a flowchart illustrating an operating method of the display device according to an exemplary embodiment of the invention.

Referring to FIGS. 1 and 5, an operating method of the display device 10 including the power supply 130 for supplying a first driving voltage AVDD1 to the components of the display device 10 and the processor 120 for controlling the power supply 130 will be described.

The processor 120 may receive, from the communication module 110, reception rate information RI on a reception rate of communication signals (S100).

The processor 120 may determine whether the first driving voltage AVDD1 is to be changed by comparing the reception rate with a reference reception rate (S110).

If the processor 120 determines that the first driving voltage AVDD1 is to be changed, the processor 120 may select at least one of a second slew rate SL2 and a second frequency FR2 with reference to the look-up table LUT (S120).

The processor 120 may generate a driving voltage control signal PCS including the at least one of the second slew rate SL2 and the second frequency FR2 (S130). The processor 120 may supply the driving voltage control signal PCS to the power supply 130.

The power supply 130 may change the first driving voltage AVDD1, based on the driving voltage control signal PCS, thereby generating a second driving voltage AVDD2 (S140).

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the application, features, characteristics, and/or elements described in connection with a particular embodiment may be used singly or in combination with features, characteristics, and/or elements described in connection with other exemplary embodiments unless otherwise specifically indicated. Accordingly, it will be understood by those of skill in the art that various changes in form and details may be made without departing from the spirit and scope of the invention as set forth in the following claims.

What is claimed is:

1. A display device comprising:

a display unit which includes a plurality of pixels for displaying images;

a scan driver which supplies scan signals to the plurality of pixels;

a data driver which supplies data signals to the plurality of pixels;

a communication module which measures a reception rate of communication signals received through an antenna;

a processor which compares the reception rate with a reference reception rate, and generate a driving voltage control signal, based on a determination result; and a power supply which generates a first driving voltage to be supplied to each of the scan driver and the data driver, wherein the power supply changes at least one of a first slew rate and a first frequency of the first driving voltage, based on the driving voltage control signal, and generates a second driving voltage having at least one of a second slew rate different from the first slew rate and a second frequency different from the first frequency, and wherein the processor includes:

a reception rate comparator which determines whether the first driving voltage is to be changed by comparing the reception rate with the reference reception rate;

a reception rate controller which determines the second slew rate and the second frequency, corresponding to a comparison result, based on whether the first driving voltage is to be changed; and a driving voltage control signal generator which generates the driving voltage control signal using at least one of the second slew rate and the second frequency.

2. The display device of claim 1, further comprising a memory which stores a look-up table including at least one of the second slew rate and the second frequency.

3. The display device of claim 1, wherein the first slew rate is greater than the second slew rate.

4. The display device of claim 1, wherein the first frequency is higher than the second frequency.

5. The display device of claim 1, wherein, when the reception rate is smaller than the reference reception rate, the reception rate comparator determines that the first driving voltage is to be changed.

6. The display device of claim 1, wherein the reception rate controller determines the second slew rate and the second frequency to have different values for every communication frequency band.

7. A display device comprising:

a display unit which includes a plurality of pixels for displaying images;

a scan driver which supplies scan signals to the plurality of pixels;

a data driver which supplies data signals to the plurality of pixels;

a communication module which measures a reception rate of communication signals received through an antenna;

a processor which compares the reception rate with a reference reception rate, and generate a driving voltage control signal, based on a determination result; and a power supply which generates a first driving voltage to be supplied to each of the scan driver and the data driver, wherein the power supply changes at least one of a first slew rate and a first frequency of the first driving voltage, based on the driving voltage control signal, and generates a second driving voltage having at least one of a second slew rate different from the first slew rate and a second frequency different from the first frequency, wherein the power supply includes:

a receiver which receives the driving voltage control signal from the processor;

a driving voltage generator which generates the first driving voltage; and a driving voltage regulator which generates the second driving voltage by adjusting the first driving voltage, based on the driving voltage control signal.

8. The display device of claim 7, wherein the receiver receives the driving voltage control signal through an inter-integrated circuit interface.

9. The display device of claim 7, wherein the driving voltage generator generates the first driving voltage by boosting a direct-current input voltage.

10. The display device of claim 7, wherein, when the second slew rate and the second frequency are not included in the driving voltage control signal, the driving voltage regulator sets the first driving voltage as the second driving voltage.

11. A method of operating a display device including a power supply for supplying a first driving voltage to each component of the display device and a processor for controlling the power supply, the method comprising:

generating, by the processor, a driving voltage control signal using a reception rate of communication signals and a reference reception rate; and generating, by the power supply, a second driving voltage by adjusting at least one of a first slew rate and a first frequency of the first driving voltage, based on the driving voltage control signal, wherein in the generating the second driving voltage, the driving voltage control signal is received from the processor, and the second driving voltage is generated, based on the driving voltage control signal, using the first driving voltage generated based on an input voltage.

12. The method of claim 11, wherein the generating the driving voltage control signal includes:

receiving a reception rate of communication signals from a communication module;

determining whether the first driving voltage is to be changed by comparing the reception rate with the reference reception rate;

selecting at least one of a second slew rate and a second frequency, based on whether the first driving voltage is to be changed; and generating the driving voltage control signal including at least one of the second slew rate and the second frequency, based on a selection result.

13. The method of claim 12, wherein, in the determining whether the first driving voltage is to be changed, it is determined that the first driving voltage is to be changed when the reception rate is smaller than the reference reception rate.

14. The method of claim 11, wherein, in the generating the second driving voltage, the second driving voltage is generated by changing at least one of the first slew rate and the first frequency, based on the second slew rate and the second frequency, included in the driving voltage control signal.

* * * * *